US010640857B2

(12) United States Patent
De Lima Figueiredo

(10) Patent No.: US 10,640,857 B2
(45) Date of Patent: May 5, 2020

(54) LOW ALLOY STEEL WITH A HIGH YIELD STRENGTH AND HIGH SULPHIDE STRESS CRACKING RESISTANCE

(75) Inventor: Alfredo De Lima Figueiredo, Carmo (BR)

(73) Assignee: Vallourec Oil & Gas France, Aulnoye-Aymeries (FR)

( * ) Notice: Subject to any disclaimer, the term of this patent is extended or adjusted under 35 U.S.C. 154(b) by 1098 days.

(21) Appl. No.: 13/130,688

(22) PCT Filed: Nov. 25, 2009

(86) PCT No.: PCT/EP2009/065851
§ 371 (c)(1),
(2), (4) Date: May 23, 2011

(87) PCT Pub. No.: WO2010/066584
PCT Pub. Date: Jun. 17, 2010

(65) Prior Publication Data

US 2011/0229364 A1 Sep. 22, 2011

(30) Foreign Application Priority Data

Dec. 9, 2008 (FR) ..... 08 58390

(51) Int. Cl.
*C22C 38/26* (2006.01)
*C22C 38/22* (2006.01)

(52) U.S. Cl.
CPC ..... *C22C 38/26* (2013.01); *C22C 38/22* (2013.01)

(58) Field of Classification Search
CPC ..... C22C 38/02; C22C 38/04; C22C 38/06; C22C 38/12; C22C 38/22; C22C 38/26
USPC ..... 420/110, 111, 114, 122–124, 127
See application file for complete search history.

(56) References Cited

U.S. PATENT DOCUMENTS 5,938,865 A * 8/1999 Kondo et al. ..... 148/593
6,267,828 B1 * 7/2001 Kushida et al. ..... 148/334
2002/0150497 A1 10/2002 Hagen et al.
2004/0187971 A1 9/2004 Omura
2008/0017284 A1 1/2008 Omura
2008/0302452 A1 12/2008 Siekmeyer et al.

FOREIGN PATENT DOCUMENTS

EP 1 496 131 A1 1/2005
EP 1 862 561 A1 12/2007
JP 61-64815 A 4/1986
JP 2001-271134 10/2001
WO WO 2007/033635 A1 3/2007

OTHER PUBLICATIONS

N. T. Tikhontseva, et al., "Development of Steels and Heat Treatment Modes for Cold-Resistant and Hydrosulfide-Resistant High-Strength Pipes", Metal Science and Heat Treatment, XP019555214, vol. 49, No. 5-6, May 1, 2007, pp. 227-231.

A. Ikeda, et al. "On the Evaluation Method of Sulfide Stress Cracking Susceptibility of Carbon and Low Alloy Steels", Corrosion Science, XP024047647, vol. 27, No. 10-11, Jan. 1, 1987, pp. 1099-1115.

J.L. Battle, et al., "Resistance of Commercially Available High Strength Tubular Goods to Sulfide Stress Cracking", An ASME Publication, XP009072821, No. 75-PET-40, Jan. 1, 1975, pp. 1-13.

International Search Report dated Jan. 26, 2010 in PCT/EP2009/065851.

* cited by examiner

*Primary Examiner* — Jenny R Wu
(74) *Attorney, Agent, or Firm* — Oblon, McClelland, Maier & Neustadt, L.L.P.

(57) ABSTRACT

A steel contains, by weight: C: 0.2% to 0.5%, Si: 0.1% to 0.5%, Mn: 0.1% to 1%, P: 0.03% or less, S: 0.005% or less, Cr: 0.3% to 1.5%, Mo: 0.3% to 1%, Al: 0.01% to 0.1%, V: 0.1% to 0.5%, Nb: 0.01% to 0.05%, Ti: 0 to 0.01%, W: 0.3% to 1%, N: 0.01% or less, the remainder of the chemical composition of the steel being constituted by Fe and impurities or residuals resulting from or necessary to steel production and casting processes. The steel can be used to produce seamless tubes with a yield strength after heat treatment of 861 MPa or more.

21 Claims, No Drawings

LOW ALLOY STEEL WITH A HIGH YIELD STRENGTH AND HIGH SULPHIDE STRESS CRACKING RESISTANCE

The invention relates to low alloy steels with a high yield strength which have an excellent sulphide stress cracking behaviour. In particular, the invention is of application to tubular products for hydrocarbon wells containing hydrogen sulphide ($H_2S$).

Exploring and developing ever and ever deeper hydrocarbon wells which are subjected to ever higher pressures at ever higher temperatures and in ever more corrosive media, in particular when loaded with hydrogen sulphide, means that the need to use low alloy tubes with both a high yield strength and high sulphide stress cracking resistance is ever increasing.

The presence of hydrogen sulphide or $H_2S$ is responsible for a dangerous form of cracking in low alloy steels with a high yield strength which is known as SSC (sulphide stress cracking) which may affect both casing and tubing, risers or drillpipes and associated products. Hydrogen sulphide is also a gas which is fatal to man in doses of a few tens of parts per million (ppm). Sulphide stress cracking resistance is thus of particular importance for oil companies since it is of importance to the safety of both equipment and personnel.

The last decades have seen the successive development of low alloy steels which are highly resistant to $H_2S$ with minimum specified yield strengths which are getting higher and higher: 551 MPa (80 ksi), 620 MPa (90 ksi), 655 MPa (95 ksi) and more recently 758 MPa (110 ksi).

Today's hydrocarbon wells reach depths of several thousand metres and the weight of the strings treated for standard levels of yield strength is thus very high. Further, the pressures in the hydrocarbon reservoirs may be very high, of the order of several hundred bar, and the presence of $H_2S$, even at relatively low levels of the order of 10 to 100 ppm, results in partial pressures of the order of 0.001 to 0.1 bar, which are sufficient when the pH is low to cause SSC phenomena if the material of the tubes is not suitable. In addition, the use of low alloy steels combining a minimum specified yield strength of 861 MPa (125 ksi) with good sulphide stress cracking resistance would be particularly welcome in such strings.

For this reason, we sought to develop a low alloy steel with both a minimum specified yield strength of 861 MPa (125 ksi) and good SSC behaviour.

Despite the fact that it is well known that the SSC resistance of low alloy steels reduces when their yield strength increases, the prior art proposes, in patent application EP-A-1 862 561, a chemical composition associated with a heat treatment enabling to obtain a low alloy steel which can satisfy current oilfield requirements.

Patent application EP-1 862 561 proposes a low alloy steel with a high yield strength (861 MPa or more) and an excellent SSC resistance, disclosing a chemical composition which is advantageously associated with an isothermal bainitic transformation heat treatment in the temperature range 400-600° C.

In order to obtain a low alloy steel with a high yield strength, it is well known to carry out a quenching and tempering heat treatment at a relatively low temperature (less than 700° C.) on a Cr—Mo alloy steel. However, according to patent application EP-1 862 561, a low temperature temper encourages a high dislocation density and the precipitation of coarse $M_{23}C_6$ carbides at the grain boundaries, resulting in poor SSC behaviour. Patent application EP-1 892 561 thus proposes to improve the SSC resistance by increasing the tempering temperature to reduce the dislocation density and to limit the precipitation of coarse carbides at the grain boundaries by limiting the joint (Cr+Mo) content to a value in the range 1.5% to 3%. However, since there is then a risk that the yield strength of the steel will fall because of the high tempering temperature, patent application EP-1 862 561 proposes increasing the C content (between 0.3% and 0.6%) associated with sufficient addition of Mo and V (respectively 0.5% or more and between 0.05% and 0.3%) to precipitate fine MC carbides.

However, there is then a risk that such an increase in the C content will cause quenching cracks with the conventional heat treatments (water quench+temper) which are applied, and so patent application EP-1 862 561 proposes an isothermal bainitic transformation heat treatment in the temperature range 400-600° C. which enables to prevent cracking during water quenching of steels with high carbon contents and also mixed martensite-bainite structures which are considered to be deleterious for SSC in the case of a milder quench, for example with oil.

The bainitic structure obtained (equivalent, according to EP-1 862 561, to the martensitic structure obtained by conventional quench+temper heat treatments) has a high yield strength (861 MPa or more or 125 ksi) associated with excellent SSC behaviour tested using NACE TM0177 methods A and D (National Association of Corrosion Engineers).

However, the industrial use of such an isothermal bainitic transformation requires that the treatment kinetics are very tightly controlled so that other transformations (martensitic or perlitic) are not triggered. Further, depending on the thickness of the tube, the quantity of water used for the quench varies, which means that tube-per-tube monitoring of the cooling rates is necessary in order to obtain a monophase bainitic structure.

The aim of the present invention is to produce a low alloy steel composition:

- which can be heat treated to produce a yield strength of 861 MPa (125 ksi) or more;
- with a SSC resistance, tested using NACE TM0177 specification method A, which is excellent especially at the yield strengths indicated above;
- and which does not require the industrial installation of a bainitic quench, which thus means that the production costs for seamless tubes are lower than those associated with application EP-1 862 561.

In accordance with the invention, the steel contains, by weight:

C: 0.2% to 0.5%
Si: 0.1% to 0.5%
Mn: 0.1% to 1%
P: 0.03% or less
S: 0.005% or less
Cr: 0.3% to 1.5%
Mo: 0.3% to 1%
Al: 0.01% to 0.1%
V: 0.1% to 0.5%
Nb: 0.01% to 0.05%
Ti: at most 0.01%
W: 0.3% to 1%
N: 0.01% or less The remainder of the chemical composition of this steel is constituted by iron and impurities or residuals resulting from or necessary to steel production and casting processes.

The influence of the elements of the chemical composition on the properties of the steel is as follows:

Carbon: 0.2% to 0.5%

The presence of this element is vital to improving the quenchability of the steel and enables the desired high performance mechanical characteristics to be obtained. A content of less than 0.2% could not produce sufficient quenchability and thus could not produce the desired yield strength (125 ksi or more). On the other hand, if the carbon content exceeds 0.5%, the quantity of carbides formed would result in a deterioration in SSC resistance. For this reason, the upper limit is fixed at 0.5%. The preferred lower and upper limits are 0.3% and 0.4% respectively and more preferably 0.3% and 0.35% respectively.

Silicon: 0.1% to 0.5%

Silicon is an element which deoxidizes liquid steel. It also counters softening on tempering and thus contributes to improving the SSC resistance. It must be present in an amount of at least 0.1% in order to have this effect. However, beyond 0.5%, it results in deterioration of SSC resistance. For this reason, its content is fixed to between 0.1% and 0.5%. The preferred lower and upper limits are 0.2% to 0.3% respectively.

Manganese: 0.1% to 1%

Manganese is an element which improves the forgeability of the steel and favours its quenchability. It must be present in an amount of at least 0.1% in order to have this effect. However, beyond 1%, it gives rise to deleterious segregation of the SSC resistance. For this reason, its content is fixed to between 0.1% and 1%. The preferred lower and upper limits are 0.3% and 0.6% respectively.

Phosphorus: 0.03% or Less

Phosphorus is an element which degrades SSC resistance by segregation at the grain boundaries. For this reason, its content is limited to 0.03% or less, and preferably to an extremely low level.

Sulphur: 0.005% or Less

Sulphur is an element which forms inclusions which are deleterious to SSC resistance. The effect is particularly substantial beyond 0.005%. For this reason, its content is limited to 0.005% and preferably to an extremely low level such as 0.003%.

Chromium: 0.3% to 1.5%

Chromium is an element which is useful in improving the quenchability and strength of steel and increasing its SSC resistance. It must be present in an amount of at least 0.3% in order to produce these effects and must not exceed 1.5% in order to prevent deterioration of the SSC resistance. For this reason, its content is fixed to between 0.3% and 1.5%. The preferred lower and upper limits are 0.4% and 0.6% respectively.

Molybdenum: 0.3% to 1%

Molybdenum is a useful element for improving the quenchability of the steel and can also increase the tempering temperature of the steel. It must be present in an amount of at least 0.3% (preferably at least 0.4%) in order to have this effect. However, if the molybdenum content exceeds 1%, it tends to favour the formation of coarse carbides $M_{23}C_6$ and KSI phase after extended tempering to the detriment of SSC resistance, and so a content of 0.6% or less is preferable. For this reason, its content is fixed to between 0.3% and 1%. The preferred lower and upper limits are 0.4% and 0.6% respectively, and more preferably 0.4% and 0.5% respectively.

Aluminium: 0.01% to 0.1%

Alumina is a powerful steel deoxidant and its presence also encourages the desulphurization of steel. It must be present in an amount of at least 0.01% in order to have its effect. However, this effect stagnates beyond 0.1%. For this reason, its upper limit is fixed at 0.1%. The preferred lower and upper limits are 0.01% and 0.05% respectively.

Vanadium: 0.1% to 0.5%

Like molybdenum, vanadium is an element which is useful in improving SSC resistance by forming fine microcarbides, MC, which enable to raise the tempering temperature of the steel. It must be present in an amount of at least 0.1% in order to have its effect, and its effect stagnates beyond 0.5%. For this reason, its content is fixed to between 0.1% and 0.5%. The preferred lower and upper limits are 0.1% and 0.2% respectively.

Niobium: 0.01% to 0.05%

Niobium is an addition element which along with carbon and nitrogen forms carbonitrides the anchoring effect of which effectively contributes to refining the grain during austenitizing. It must be present in an amount of at least 0.01% in order for it to have its effect. However, its effect stagnates beyond 0.05%. For this reason, its upper limit is fixed at 0.05%. The preferred lower and upper limits are 0.01% and 0.03% respectively.

Titanium: at Most 0.01%

A Ti content of more than 0.01% favours the precipitation of titanium nitrides TiN in the liquid phase of the steel and results in the formation of coarse TiN precipitates which are deleterious to the SSC resistance. Ti contents of 0.01% or less may result from the production of liquid steel (constituting impurities or residuals) and not from deliberate addition. However, such small amounts do not have a substantial effect on the steel. For this reason the Ti content is limited to 0.01%, and preferably to less than 0.005%.

Tungsten: 0.3% to 1%

Like molybdenum, tungsten is an element which improves the quenchability and the mechanical strength of the steel. It is an element which is important in the invention which not only enables that a substantial Mo content be tolerated without causing the precipitation of coarse $M_{23}C_6$ and KSI phase during extended tempering, to the advantage of fine and homogeneous precipitation of microcarbides MC, but also to limit the increase in size of microcarbides MC by dint of its low diffusion coefficient. Tungsten thus enables to increase the molybdenum content to raise the tempering temperature and thus to reduce the dislocation density and improve SSC resistance. It must be present in an amount of at least 0.3% in order to have its effect. Beyond 1%, its effect stagnates. For this reason, its content is fixed to between 0.3% and 1%. The preferred lower and upper limits are 0.3% and 0.6% respectively.

Nitrogen: 0.01% or Less

A nitrogen content of more than 0.01% reduces the SSC resistance of steel. Thus, it is preferably present in an amount of less than 0.01%.

Example of an Embodiment

Two industrial steel castings in accordance with the invention were produced then worked by hot rolling into seamless tubes with external diameters of 244.5 and 273.1 mm and with a thickness of 13.84 mm. These tubes were heat treated by quenching with water and tempering so that they had a yield strength of 861 MPa (125 ksi) or more.

Specimens were produced from these tubes for the tests described below.

27 mm thick rolled plates from two castings which were not in accordance with the invention (Cr and Mo contents close to 1%, no W addition, V content close to 0.05%) were also tested for comparison purposes.

Table 1 shows the chemical composition of the two castings of the invention (references A and B) and the chemical composition of the two comparative castings which were not in accordance with the present invention (references C and D) (all the % are expressed as the % by weight).

The Applicant selected a Mo and Cr content in the range 0.4% to 0.6% for each of these two elements, such contents being capable, as determined by preliminary tests and the experience of the Applicant, of preventing the formation of $M_{23}C_6$ type carbides and favouring the formation of MC type carbides.

TABLE 1

| Ref | C | Si | Mn | P | S** | Cr | Mo | Al | Ti | Nb | V | N | W |
|---|---|---|---|---|---|---|---|---|---|---|---|---|---|
| A | 0.34 | 0.29 | 0.43 | 0.013 | ND | 0.51 | 0.41 | 0.03 | 0.005 | 0.021 | 0.17 | 0.006 | 0.46 |
| B | 0.35 | 0.31 | 0.45 | 0.010 | ND | 0.49 | 0.41 | 0.04 | 0.008 | 0.021 | 0.17 | 0.005 | 0.43 |
| C* | 0.38 | 0.34 | 0.36 | 0.012 | 0.002 | 1.03 | 0.90 | 0.02 | 0.002 | 0.002 | 0.07 | 0.003 | <0.01 |
| D* | 0.34 | 0.29 | 0.42 | 0.011 | ND | 0.91 | 0.80 | 0.03 | 0.003 | 0.030 | 0.05 | 0.003 | — |

*comparative example (no W added)

**ND for element S means a content of 0.0011% or less

Table 2 indicates the yield strength values obtained after heat treating the steel of the invention.

TABLE 2

| Ref | Product and dimensions Diameter × thickness or thickness (mm) | Heat treatment (**) | Yield strength MPa (ksi) | Ultimate Tensile Strength MPa (ksi) |
|---|---|---|---|---|
| A | Tube 244.5 × 13.84 mm | TE + R + TE + R | 896 (130) | 985 (143) |
| B | Tube 244.5 × 13.84 mm | TE + R + TE + R | 930 (135) | 978 (142) |
| C* | Rolled plate 27 mm | TE + TE + R | 924 (134) | 1012 (147) |
| D* | Tube 273.1 × 13.84 mm | TE + R + TE + R | 923 (134) | 999 (145) |

*comparative example (**) TE = water quench; R = temper

Table 3 shows the results of tests to evaluate the SSC resistance using method A of specification NACE TM0177.

The test specimens were cylindrical tensile specimens taken longitudinally at half the thickness from the tubes and machined in accordance with method A of specification NACE TM0177.

The test bath used was of the EFC type (European Federation of Corrosion). The aqueous solution was composed of 5% sodium chloride (NaCl) and 0.4% sodium acetate ($CH_3COONa$) with a 3% $H_2S$/97% $CO_2$ gas mixture bubbled through continuously at 24° C. (±3° C.) and adjusted to a pH of 3.5 using hydrochloric acid (HCl).

The loading stress was fixed at 85% of the specified minimum yield strength (SMYS), i.e. 85% of 861 MPa. Three specimens were tested under the same test conditions to take into account the relative dispersion of this type of test.

The SSC resistance was judged to be good (symbol 0) in the absence of rupture of three specimens after 720 h and poor (symbol X) if rupture occurred before 720 h in the calibrated portion of at least one specimen out of the three test pieces.

TABLE 3

| | Nace test method A | | | | |
|---|---|---|---|---|---|
| | Environment | | Applied stress | | |
| Ref | pH | $H_2S$ (%) | Loading stress | MPa (ksi) value | Result >720 h |
| A | 3.5 | 3 | 85% SMYS | 732 (106.3) | O |
| B | 3.5 | 3 | 85% SMYS | 732 (106.3) | O |
| C* | 3.5 | 3 | 85% SMYS | 732 (106.3) | X |
| D* | 3.5 | 3 | 85% SMYS | 732 (106.3) | X |

*comparative example

The results obtained for references A and B of the steel of the invention were excellent, in contrast to those for references C and D for the comparative steels.

The steel of the invention is of particular application to products intended for the exploration and production of hydrocarbon fields, such as in casing, tubing, risers, drill-pipes, drill collars or for accessories for the above products.

The invention claimed is:

1. A low alloy steel comprising the following components, by weight:

C: 0.2% to 0.5%
Si: more than 0.1% to 0.5%
Mn: more than 0.1% to 1%
P: 0.03% or less
S: 0.005% or less
Cr: 0.3% to 1.5%
Mo: 0.3% to 1%
Al: 0.01% to 0.1%
V: 0.1% to 0.5%
Nb: 0.01% to 0.05%
W: 0.43% to 0.46%
N: 0.01% or less, the remainder of the chemical composition of said steel comprising Fe and impurities or residuals resulting from or necessary to steel production and casting processes, wherein W is present in the steel in a Mo tolerance increasing effective amount.

2. A steel according to claim 1, wherein its C content is in the range of from 0.3% to 0.4%.

3. A steel according to claim 1, wherein its Mn content is in the range of from 0.3% to 0.6%.

4. A steel according to claim 1, wherein its Cr content is in the range of from 0.4% to 0.6%.

5. A steel according to claim 1, wherein its Mo content is in the range of from 0.4% to 0.6%.

6. A steel according to claim 5, wherein its Cr content is in the range of from 0.4% to 0.6%.

7. A steel according to claim 1, wherein its S content is 0.003% or less.

8. A steel according to claim 1, wherein its Al content is in the range of from 0.01% to 0.05%.

9. A steel according to claim 1, wherein its V content is in the range of from 0.1% to 0.2%.

10. A steel according to claim 1, wherein its Nb content is in the range of from 0.01% to 0.03%.

11. A steel product according to claim 1, wherein said steel is heat treated so that its yield strength is 861 MPa (125 ksi) or more.

12. A steel product produced from the steel according to claim 1, wherein said steel product has a yield strength of 861 MPa or more and wherein said steel product has SSC resistance such that rupture does not occur after 720 hours of treatment in accordance with method A of specification NACE TM0177.

13. A steel according to claim 1, wherein an amount of W is present in the alloy which is effective in limiting microcarbide size increase in the alloy.

14. A steel product produced from the steel according to claim 13, wherein said steel product has a yield strength of 861 MPa or more and wherein said steel product has SSC resistance such that rupture does not occur after 720 hours of treatment in accordance with method A of specification NACE TM0177.

15. A steel according to claim 1, wherein if Ti is present in the steel as an impurity, Ti is present in an amount less than 0.005%.

16. A low alloy steel consisting essentially of the following components, by weight:

C: 0.2% to 0.5%
Si: more than 0.1% to 0.5%
Mn: more than 0.1% to 1%
P: 0.03% or less
S: 0.005% or less
Cr: 0.3% to 1.5%
Mo: 0.3% to 1%
Al: 0.01% to 0.1%
V: 0.1% to 0.5%
Nb: 0.01% to 0.05%
W: 0.43% to 0.46%
N: 0.01% or less, the remainder of the chemical composition of said steel consisting essentially of Fe and impurities or residuals resulting from or necessary to steel production and casting processes, wherein W is present in the steel in a Mo tolerance increasing effective amount.

17. A steel according to claim 16, wherein its Mo content is in the range of from 0.4% to 0.6%.

18. A steel according to claim 17, wherein its Cr content is in the range of from 0.4% to 0.6%.

19. A steel product produced from the steel according to claim 16, wherein said steel product has a yield strength of 861 MPa or more and wherein said steel product has SSC resistance such that rupture does not occur after 720 hours of treatment in accordance with method A of specification NACE TM0177.

20. A steel according to claim 16, wherein an amount of W is present in the alloy which is effective in limiting microcarbide size increase in the alloy.

21. A steel product produced from the steel according to claim 20, wherein said steel product has a yield strength of 861 MPa or more and wherein said steel product has SSC resistance such that rupture does not occur after 720 hours of treatment in accordance with method A of specification NACE TM0177.

* * * * *